United States Patent [19]

Himi

[11] 4,037,187

[45] July 19, 1977

[54] METAL CLAD INSULATING CIRCUIT BREAKER

[75] Inventor: Hitoshi Himi, Tokyo, Japan

[73] Assignee: Kabushiki Kaisha Meidensha, Tokyo, Japan

[21] Appl. No.: 529,484

[22] Filed: Dec. 4, 1974

[30] Foreign Application Priority Data

Dec. 10, 1973 Japan ..... 48-139173

[51] Int. Cl.[2] ..... H01H 61/00

[52] U.S. Cl. ..... 337/121; 174/150; 200/144 B; 337/186; 337/327

[58] Field of Search ..... 335/202; 337/20, 121, 337/201, 327, 186; 174/50, 51, 150; 200/144 B, 148, 303, 307

[56] References Cited

U.S. PATENT DOCUMENTS

| | | | |
|---|---|---|---|
| 2,542,798 | 2/1951 | Cumming | 174/150 X |
| 3,495,027 | 2/1970 | Lambeth et al. | 174/150 X |
| 3,617,618 | 11/1971 | Albright | 174/150 X |
| 3,868,616 | 2/1975 | Yonkers | 337/201 |

*Primary Examiner*—George Harris
*Assistant Examiner*—Fred E. Bell

[57] ABSTRACT

A casing is divided and disassembled into the desired numbers of solid state insulating material units each of which is aligned with the others, with tapered end portion of the solid state insulating material units, and insulating bushing means, such as rubber gaskets or stress relief cones, which are inserted into the contact portions between said each insulating material units, and further solid state insulating units fastened by a common fastening means in a body with uniform compressive force.

12 Claims, 5 Drawing Figures

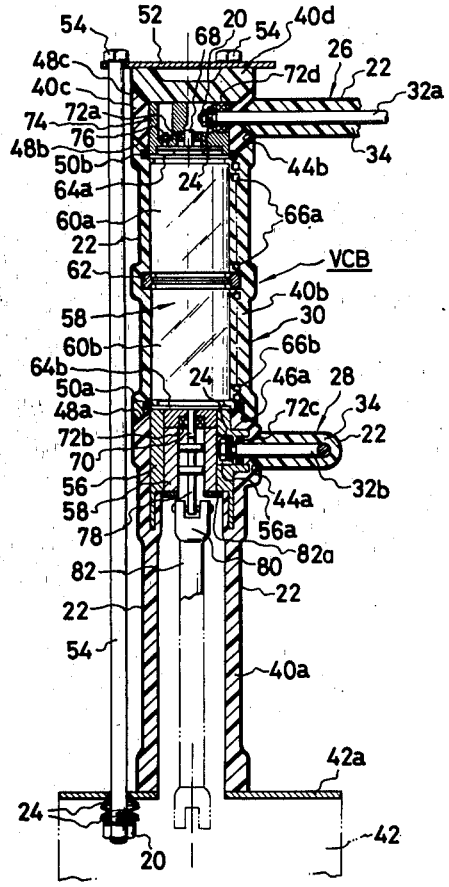

METAL CLAD INSULATING CIRCUIT BREAKER

BACKGROUND OF THE INVENTION

The present invention relates to a metal clad insulating circuit breaker, and more particularly to an improvement of a solid insulating circuit breaker.

In known switching apparatus designed for a nominal voltage of more than 60 kV, gaseous insulating materials have been employed instead of solid insulating materials. For the necessary dielectric strength, the gas must be maintained at high pressure, and the gas pressure must be monitored periodically for detection of leakage and replenishment of gas lost. Solid insulating materials are free of this shortcoming, but the necessary heavy layers of solid material tend to crack due to the different rates of thermal expansion of the insulating material and of the metallic conductors embedded therein, and corona discharge and current leaks occur at the cracks. For this reason, solid insulating materials have been used only in electric machinery operating at maximum nominal voltages of 20 to 30 kV.

Recently, in large cities, with the growth in population and the excessive density of buildings and industrial institutions, the need for electric power has rapidly increased, but it is always very difficult to relocate transformer substation in the build-up areas of large cities.

Accordingly, the efforts of the art are directed at the reduction of the site and of the size of the transformer substation. Accordingly, an insulating breaker of small size is required, therefore, the insulating breaker has been manufactured in a small size, instead of using air insulation requiring the long insulation distance, by employing solid, liquid or gas insulation between the electrically conductive parts and the grounded member to shorten the insulation distance.

The breaker according to one of the above insulation methods, for example, the breaker of the 20–30 kV class with solid state insulation has been manufactured by locating inside the mold its live conductive parts such as lead wires, breaker unit and the like, injecting a molten electric insulating material composed mainly of epoxy resin into the space between the mold and the live conductive parts including the breaker unit, and forming all parts in one mold body.

In this case, even if the breakers have equal ratings, various mold types must be prepared according to the fitting conditions of the breakers (for example, the fitting dimensions of the breaker for the face of power panel). When the exterior form of the breaker or the using conditions so require the breaker must be manufactured each time by molding the breaker unit and the lead wires in one piece. Accordingly, various mold types are required and mold manufacturing become uneconomical.

In case of manufacturing of the circuit breaker for low voltage according to said molding method, as relatively large scale production of the breaker at one and the same electric rating is required, the adequate returns will result. But when the circuit for the breaker is of high or ultra-high voltage, the breaker according to the solid material insulation method is generally not required in large quantities, and as the molded produce becomes large and complex, the mold therefore becomes very costly and uneconomical to produce.

Conventional and prior solid insulating electric arrangements of this type are shown in FIGS. 1 and 2.

Such arrangements are, generally, used for a breaker of the 20 30 kV class. In the arrangement shown in FIG. 1, a cylindrical live conductor portion 10 is enveloped by molded-on tubular members 12 and 14 of insulating material of uniform diameter. These tubular members 12 and 14 have, respectively, flanges **12*a* and 14*a* for fastening to each other in an air-tight relationship by employing a gasket 16, bolts 18 and nuts 20. Further, the surfaces of these tubular member 12 and 14 are shielded and grounded by a metallic conductor 22, so the insulation treatment corresponding to the insulating class is necessary in order to obtain the required dielectric strength. The dielectric strength is maintained by means of compressing the packing means such as rubber gasket 16. In this case, the compressive strength is imparted to the rubber gasket 16 by the fastening strength of bolts 18 and nuts 20, and, furthermore, the fastening strength of the bolts and nuts imparts the compressive strength Q to the rubber gasket 16 and the tubular members 12 and 14 which are composed of solid insulating material such as epoxy resin, and as a result the compressed rubber gasket 16 imparts the reactive force to tubular members 12 and 14. Accordingly, the flanges 12*a* and 12*b* receive the bending moment due to the above two forces P and Q, therefore the compressive strength required for the dielectric strength is restricted from the structural viewpoint. It is, therefore, uneconomical to manufacture the electrical arrangement of nominal voltage of more than 60 KV based on the principle of FIG. 1 because the molded-on tubular member 12, 14** requires a large increase of the mechanical strength to be applied thereon.

To achieve this, in the prior arrangement, spring members 24 is provided with the bolts 18 as shown in FIG. 2. However, in this case, the diameter R between the bolts arranged on the circumference of flanges **12*a*, 14*a*** becomes large, and thus the bending moment increases, owing to the active and reactive forces P, Q.

It is, therefore, pointed out that the breakers using the solid state insulation are operable with only 20 to 30 KV capacities and are thus incompatible with systems in excess of 60 KV. This is due to the difficulty in molding the solid state insulation to a sufficient and precisely controlled thickness and due to fissures produced in the solid insulation owing to the difference between the coefficients of thermal expansion of the solid insulation and metallic parts which are embedded in the solid insulation.

It is, therefore, an object of the present invention to provide a circuit breaker of the metal clad type which overcomes the above drawbacks, namely, a circuit breaker arrangement in which the bending moment in the molded casing is reduced.

Another object of the present invention is to provide an electrical device of the metal clad type capable of using ultra-high voltage equipment, economically.

A further object of the present invention is to provide a relatively small-sized and highly reliable circuit breaker which can be manufactured inexpensively and easily.

SUMMARY OF THE INVENTION

With the above in view, the present invention comprises a circuit breaker arrangement of the above type, wherein the solid insulating material unit is divided into the required components, and each solid insulating material unit is aligned with the others, and an insulating bushing such as a rubber gasket or a stress relief cone is inserted into the jointing portion between said solid insulating materials, and furthermore said solid insulating material units are fastened by a common fastening means in order to fasten with uniform compressive force.

More particularly, the present invention relates to a circuit breaker arrangement which comprises a first solid insulating unit such as a solid insulated supporting member including a first electrical connecting member, a second solid insulating unit enveloping an interrupting member, a third solid insulating unit including a second connecting member, a fourth solid insulating unit such as a fixing member, first and second connecting jacket members to be connected between said connecting members, respectively, and fastening means for fastening first through fourth solid insulating units in a unit.

Additional objects and advantages of the present invention will become apparent upon consideration of the following description when taken in conjunction with the accompanying drawings.

DESCRIPTION OF THE PREFERRED EMBODIMENTS

Figure 3:
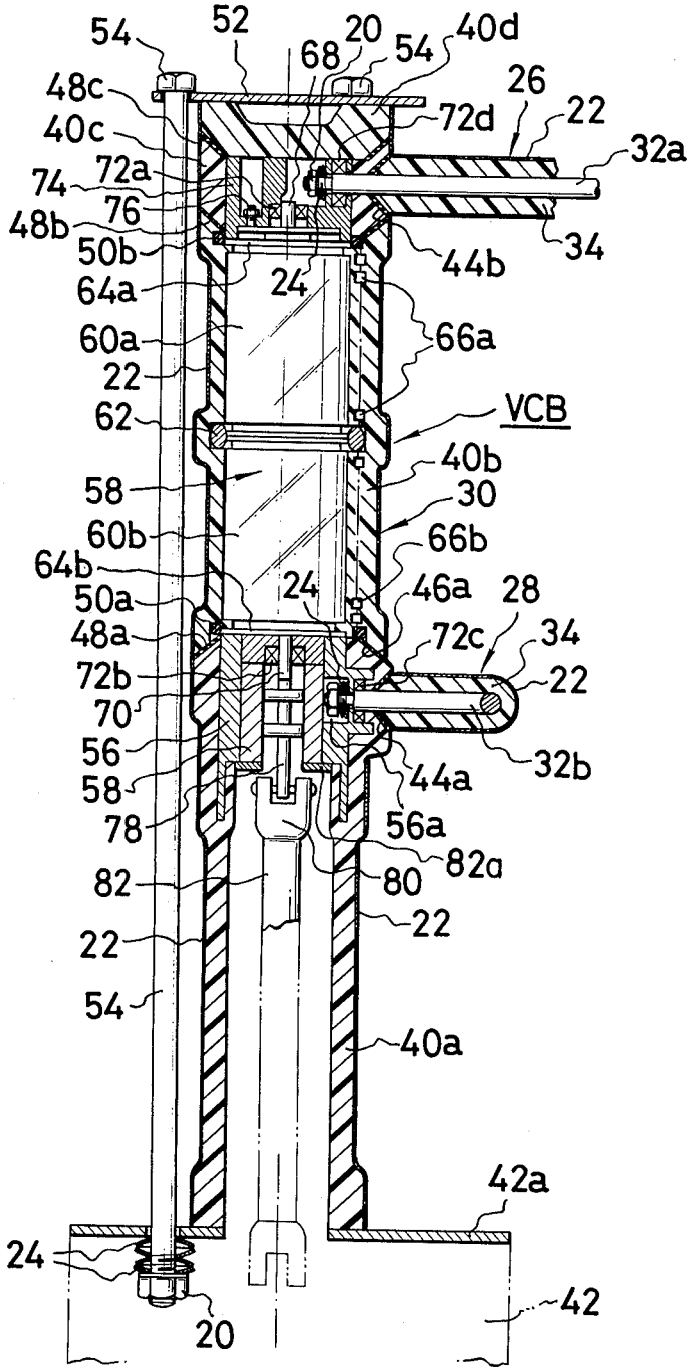
FIG. 3 is a partial vertical view of a preferred embodiment of the solid insulating circuit breaker arrangement in accordance with the present invention.

Referring to the drawings, particularly to FIG. 3, there is shown a solid insulating circuit breaker or interrupter, more specially a vacuum circuit breaker VCB according to the present invention. This breaker includes insulated electrical conductors 26, 28 and a casing 30.

Certain words are used in this application indicating direction, relative position, and the like. Such words are used for the sake of clearness and brevity. Also, such words are used only in connection with the view of the drawing, and the parts so described, in actual use, may have different direction, relative position, and the like. Examples of such words are "upper," "lower," "vertical," "horizontal," and the like.

Figure 4:
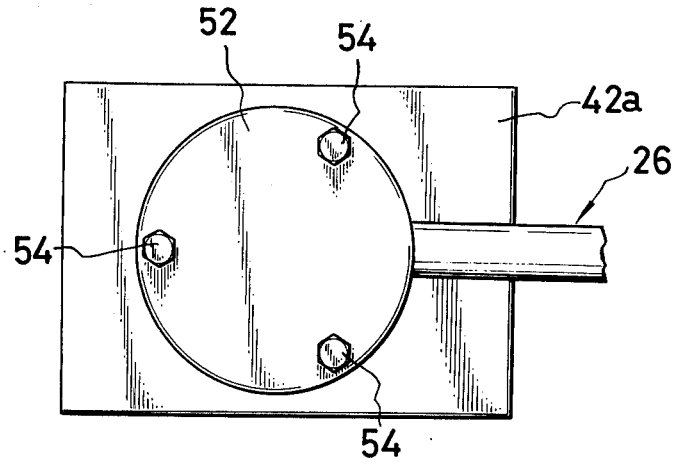
FIG. 4 is a plan view of the circuit breaker arrangement in accordance with the present invention shown in FIG. 3.

The casing 30 comprises a first solid insulating tubular unit 40*a* consisting of the epoxy resin, a second solid insulating tubular unit 40*b*, a third solid insulating tubular member 40*c* and a fourth solid insulating tubular unit 40*d*. The first tubular unit 40*a* is located on the upper board 42*a* of the operation unit 42. On the upper and circumferential portion of the tubular unit 40*a*, the concave 44*a* formed tapering surface thereof is provided, and the extremely upper end portion of tubular unit 40*a* is provided with tapered portion 46*a*. The extreme both end portions of second tubular unit 40*b* are, similarly, tapered respectively, and the lower tapered portion of the second tubular unit 40*b* is secured through a rubber gasket 48*a* and a shield ring 50*a* to the tapered portion of the first tubular unit 40*a*. The solid insulating tubular unit 40*c* has a radial and circumferential tapered concave 44*b* connected thereto, and the both extreme end portions are tapered. The lower tapered portion of the third tubular unit 40*c* is fitted through an insulating and stress relief packing means 48*b* and an O-shaped shield ring 50*b*. The fourth insulating unit such as a metallic medium 40*d* formed with the V-shape is fastened through a rubber gasket 48*c* to the upper tapered portion of the third tubular unit 40*c*, and on the external radially extending upper portion of the V-shaped medium 40*c*, a metal circular plate 52 is located. These first tubular units 40*a* to 40*c* are fastened and secured in a unit through the V-shaped medium 40*c* and metal circular plate 52 by means of the several fasteners such as bolts 54, springs 24 and nuts 20, as shown in FIG. 4.

Figure 1:
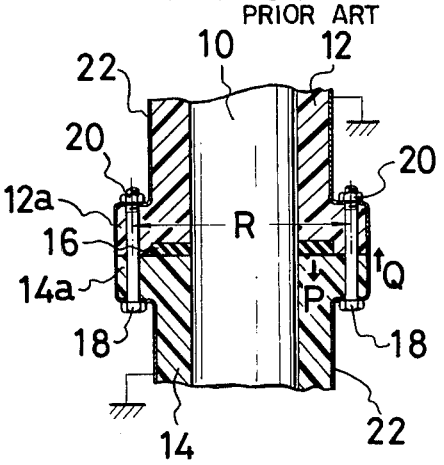
FIG.1 PRIOR ART
FIGS. 1 and 2 already referred to above, are the partial vertical sections of the known and prior art electric arrangement.
Figure 2:
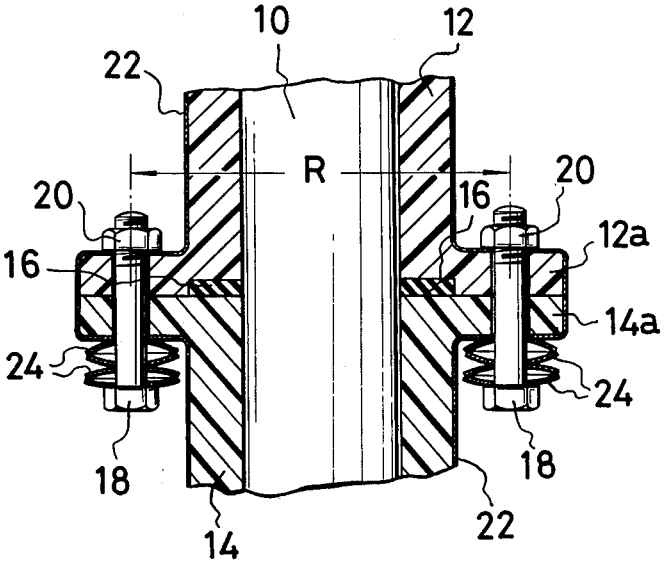
FIG.2 PRIOR ART
Figure 5:
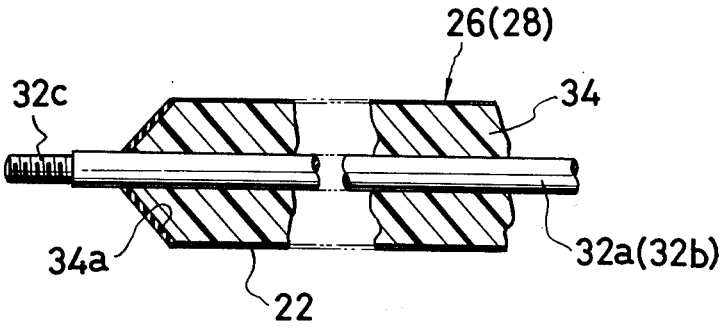
FIG. 5 is a partial sectional view of an insulated conductor for the disconnecting section preferred for the circuit breaker shown in FIG. 3.

The circuit breaker VCB also includes insulated electrical conductors 26, 28, and, as shown in FIG. 5, the insulated electrical conductors or leads 26 are respectively formed with an elongated electric conductor 32*a* of a fixed length and a circumferential layer 22. Both ends of electric conductor 32*a* are exposed for connecting to another electric conductors, and each end is formed with a threaded portion 32*c*. The layer 22 is provided with a cylindrical solid insulator 34 of epoxy resin and an electrically grounding cylindrical layer of greater diameter, and at least one end portion is formed with the tapered portion 34*a*. Inside the first tubular unit 40*a*, a metallic cylindrical medium 56 is molded in one piece with the tubular unit 40*a*, and metallic medium 56 has a passageway opening toward the outer circumferential surface. A metallic cylindrical tube 58 is inserted into the inner surface of the metallic medium 56. Inside the second solid insulating tubular unit 40*b*, a vacuum breaker unit 58 is inserted. This unit 58 is shown to include two cylindrical glass containers 60*a* and 60*b*, a ring-shaped electric conductor portion such as a shield ring 62 connecting the containers to each other, and electrically conductive plates or flanges 64*a*, 64*b*. Voltage dividing capacitors 66*a*, 66*b* and, molded within the second solid insulating tubular unit 40*b* and, also, within the containers 60*a*, 60*b*, fixed and movable contacts (not shown in the drawing) are provided. The one end of the movable rod 68 connected to said fixed contact passes through the first conducting plate 64*a* and appears on the upper portion of the unit 58. The movable rod 70 connected to said movable contact passes through the second plate 64*b*, lower metallic plate which is inserted fixedly into the medium 56 and the conductive connecting ring 71*b*. The right side surface (viewed in FIG. 1) of the metallic medium 56 includes an aperture 56*a* wherein the exposed left end threaded portion 32*c* (in FIG. 3) of the insulated conductor 32*b* for connecting another equipment such as a disconnecting switch is inserted through the ring-shaped contact 72*c*, and the conductor is fastened by the nuts 18 and the plate springs 24, and the layer 28 is attached to the tapered portion 44*a* of the tubular unit 40*a*. Inside the third solid insulating unit 40*c*, a metallic medium 74 is molded in one piece. The conductor 32*b* is also inserted into the ring-shaped contact 72*d* located within the medium 56 communicated with the tapered aperture 44*b*, and the threaded portion 32*c* of the conductor 32*a* is fastened to the contact 72*d* by the nut 20 and the plate spring. The medium 74 is firmly secured to the first end plate 64*a* by a suitable fastening means such as a screw 76.

Additionally, the first solid insulating tubular unit 40*a* includes a sliding rod 78 connected to the movable rod 70 by suitable means, a coupling 80 connected pivotally to the sliding rod 78, an insulated driving rod 82 and a guide plate 82*a*. And, furthermore, the outer surfaces of the casing 30 are grounded by the metallic cones 22 in order to prevent corona discharge. Accordingly, the live conductive portions in the casing 30 are insulated from the ground by said solid insulating materials.

As described above, according to the circuit breaker in accordance with the present invention, in constructing, all extreme end portions of each solid insulating tubular units 40*a*–40*d* are formed with the conical tapers or cone-shaped for the purpose of increasing the contact area, and each cone-shaped insulating packing is inserted between each portion of the casing 30, for obtaining the high-reliability in the jointing portions.

The casing 30 is longitudinally and uniformly compressed between the lower most base plate 42*a* of the operating unit 42 and the upper most securing plates 52 by employing at least three bolts 54, plate springs 24 and nuts 20, with the suitable compressing strength. The compressing force is uniformly applied to the insulating rubber gasket inserted into the jointing portion, and, therefore, is the only compressing force applied to each solid insulating unit.

In manufacturing the breaker VCB, the first solid insulating tubular unit 40*a* connecting the conductor or lead 32*b* is placed on top of operating unit 42, thereafter the second solid insulating tubular unit 40*b* is placed on top of the first unit 40*a*, the third solid insulating tubular unit 40*c*, wherein the electrical conductor or lead 32*a* is previously connected thereto is placed on top of the second tubular unit 40*b*, and, then, the fourth solid insulating V-shaped unit 40*d* is placed on top of the third solid insulating tubular unit 40*c*, and finally the casing 30 is firmly fastened to the operating unit 42 by means of the upper plate 52, bolts 54, nuts 20 and plate springs 24. The compressing force is evenly applied to the all rubber gaskets 72*a* through 72*d*, and the only compressing force is, of course, imparted to all solid insulating materials. The plate springs 24 adjusts, constantly to, the variation of the compressing strength resulting from long time usage.

Another important advantage is the fact that, as all the solid insulating members are manufactured individually and separately, the vacuum circuit breaker and the voltage dividing capacitors can be molded on the solid insulating tubular in one piece as well as the shield-rings, and, although the solid state insulating material is very weak for the extension strength and bending stress, as only compressive force is applied to the solid state materials, the circuit breaker arrangement for using the equipment at nominal voltages in excess of 60 kV can be easily manufactured.

As apparent from the foregoing, in accordance with the present invention, as the solid insulating material units are separately manufactured, the electrical arrangement of the metal clad type can be produced economically and easily. Since the main insulating tubular units are of a simple form without using the flange construction, the molding price is moderate. Further, if the circuit breaker is required to change its fitting or mounting conditions only the length of the insulated conductor needs to be changed instead of changing the main solid-state insulating unit. Accordingly, the mold types can be limited to a small number, and circuit breakers for voltages in excess of 60 kV may be economically manufactured.

While the invention has been particularly described with reference to preferred embodiment, changes and modifications may be easily possible to those skilled in the art. But it is intended to cover all the changes and modifications which do not constitute departures from the spirit and scope of the invention.

What is claimed is:

1. A circuit breaker arrangement comprising a casing of solid insulating material with a plurality of solid insulating material units, a breaker unit within said casing and having a movable and a fixed contact therein, two insulated electric conductors joined to said casing, and fastening means for fastening said plural solid insulating material units into a body, each of said conductors being electrically connected respectively to said fixed and movable contacts of said breaker unit, said conductors including an elongated electric conductor and a solid insulating material layer formed therearound; a first solid insulating unit with a solid insulated supporting member including a first connecting member and a taper on a one open end portion, the circumferential surface thereof having a tapered cavity, an interrupting member and voltage dividing capacitors, a second solid insulating unit enveloping said interrupting member and voltage dividing capacitors and being joined to said first solid insulating unit, a third solid insulating unit including a second connecting member and joined to said second solid insulating unit, a fourth solid insulating unit for fixing said second connecting member to said third solid insulating unit therein, first and second connecting jacket members for connecting between said first and second connecting members respectively, and fastening means for fastening said four solid insulating units into a body.

2. A circuit breaker arrangement as claimed in claim 1 wherein open end portions of said second, third and fourth solid insulating units are tapered.

3. A circuit breaker arrangement as claimed in claim 1 wherein said first connecting member is molded in a body within said first solid insulating unit.

4. A circuit breaker arrangement as claimed in claim 1 wherein said elongated conductors of said first and second jacket members are, respectively, connected to said first and second connecting members by nuts and plate springs when connected to further switching means.

5. A circuit breaker arrangement comprising a casing of solid insulating material with a plurality of solid insulating material units, a breaker unit within said casing and having a movable and a fixed contact therein, two insulated electric conductors joined to said casing, and fastening means for fastening said plural solid insulating material units into a body, each of said conductors being electrically connected respectively to said fixed and movable contacts of said breaker unit, said conductors including an elongated electric conductor and a solid insulating material layer formed therearound; said casing including a first solid insulating tubular member with open end portions one of which is tapered and which has a circumferential surface with a tapered cavity, a second solid insulating tubular member including a breaker unit hereinto, a third solid insulating tubular member including a metallic connector for connecting said breaker unit to said elongated conductor of the solid insulated conductor.

6. A circuit breaker arrangement comprising a casing of solid insulating material, a metal circular plate, an operation unit with tapered end portions, a plurality of solid insulating material units superimposed and in alignment with each other through stress relief cones between said metal circular plate and said operation unit, a vacuum interrupter unit within said casing and having a movable and fixed contact therein, a first connecting member including a metallic medium and first and second ring contacts electrically connected to said fixed contact, a second connecting member including a metallic medium, first and second ring contacts and a metallic cylindrical tube inserted into the inner surface of said metallic medium and electrically connected to said movable contact, two insulated electrical conductors joined to said casing and each connected respectively to said fixed and movable contacts of said vacuum interrupter unit through said first and second connecting members, said conductors including an elongated electrical conductor and a solid insulating material layer formed therearound, and fastening means for fastening said plural solid insulating material units into a body, said fastening means including at least three unitary bolts, nuts and plate springs provided around the circumference and secured between a metal circular plate and a lower-most base plate of an operating unit of the breaker.

7. A circuit breaker arrangement as claimed in claim 6, further comprising a first solid insulating unit with a solid insulated supporting member including a first connecting member and a taper on a one end portion, said one end portion being open, the circumferential surface thereof having a tapered cavity, vacuum interrupting unit, a second solid insulating unit surrounding said interrupting member and joined to said first solid insulating unit, a third solid insulating unit including a second connecting member and joined to said second solid insulating unit, a fourth solid insulating unit for fixing said second connecting member to said third solid insulating unit therein, first and second connecting jacket members for connecting between said first and second connecting members respectively, and fastening means for fastening said four solid insulating units into a body, open end portions of said second, third and fourth solid insulating units being tapered.

8. A circuit breaker arrangement as claimed in claim 6 wherein at least one of end portions of said insulated electric conductors has a threaded portion.

9. A circuit breaker arrangement as claimed in claim 6, wherein said casing includes a first solid insulating tubular member with open end portions one of which is tapered an which has a circumferential surface with a tapered cavity, a second solid insulating tubular member including a breaker unit hereinto, a third solid insulating tubular member including a metallic connector for connecting said breaker unit to said elongated conductor of the solid insulated conductor.

10. A circuit breaker arrangement as claimed in claim 7, wherein said first connecting member is molded in a body within said first solid insulating unit.

11. A circuit breaker arrangement as claimed in claim 7, wherein said elongated conductors of said first and second jacket members are, respectively, connected to said first and second connecting members by nuts and plate springs when connected to further switching means.

12. A circuit breaker arrangement as claimed in claim 7 including voltage dividing capacitors surrounded by said second solid insulating unit.

* * * * *